United States Patent [19]

Baughman

[11] Patent Number: 4,572,113

[45] Date of Patent: Feb. 25, 1986

[54] WATER LEAK CONTROL CIRCUIT

[76] Inventor: George W. Baughman, 106 S. Interlachen, Winter Park, Fla. 32789

[21] Appl. No.: 697,156

[22] Filed: Feb. 1, 1985

[51] Int. Cl.[4] ..... F22B 37/42

[52] U.S. Cl. ..... 122/504.2; 122/507; 165/134.1

[58] Field of Search ..... 122/504, 504.2, 507; 236/94; 165/134; 137/456

[56] References Cited

U.S. PATENT DOCUMENTS 3,063,432 11/1962 Bond et al. ..... 122/504

3,069,671 12/1962 Taylor ..... 122/504 X 4,469,051 9/1984 Malaval ..... 122/507

*Primary Examiner*—Edward G. Favors

*Attorney, Agent, or Firm*—Harold A. Williamson

[57] ABSTRACT

A water leak control circuit in combination with a water heater having an inlet and a drain. The water leak control circuit simultaneously detects leaks, actuates an alarm, shuts off a water supply to the water heater, drains the heater, while releaseably maintaining the alarm activated, the water supply shut off and the heater drained, all of which is accomplished by means of leak responsive circuit.

20 Claims, 5 Drawing Figures

FIG. 1

WATER LEAK CONTROL CIRCUIT

TECHNICAL FIELD

This invention relates to a water leak control circuit for use with a hot water heater.

BACKGROUND ART

Ever since the invention of the first stand alone hot water heater, owners of such water heaters have had to face the grim reality that the continuous use of the heaters over the years might result in a leak developing in the water heater tank. In the past, for most individuals, the appearance of a leak was evidenced by a gradually increasing presence of water or moisture in a region beneath and around the water heater. Accordingly most water leaks were detected early, by the occupants of the dwelling having the leaking water heater, usually before a catastrophically large leak developed. Single family homes typically locate the water heater in the basement on concrete floors with floor drains in close proximity to thereby minimize leaked water damage.

Today more than ever before, self contained condominiums are in the forefront of new home developments. It is not uncommon to find, especially in resort areas multistory condominium structures having hundreds of self contained units.

By self contained it is meant that each unit has its own furnace, air conditioning and hot water heater. The occupants of these condominiums are frequently transient in their use of the units, with many months or weeks arising where no one is present to observe the region surrounding a water heater to detect a leak. While most condominium owners set back the thermostat on the water heater to conserve energy while they are away it has been found that few consistently go one step further and turn-off the water heater. The circumstances just described create an environment in which an undetected hot water leak can result in extensive if not catastrophic damage to dwelling units on floors below the floor in which a water leak appears. Many days may elapse before the appearance of damage on lower floors will be discerned.

In view of the above it is not surprising that the problem of hot water leak detection has been addressed by an inventor.

Just such an example will be found in the patent to Frisby U.S. Pat. No. 4,252,088 which is directed to a differential switch for detecting leaks. The Frisby system depends upon the detection of a differential water flow rate across a water heater. Frisby operates on the principle that when there is no leak in the water heater then the flow rate into and out of the heater is the same. Frisby utilizes what must be categorized as extremely sensitive flow detection devices at both the inlet and outlet of the water heater. The flow detection devices detect the flow rate into and out of the heater and when the flow rate differs he shuts off the water supply. The assumption being that only when there is a leak will the flow rate be different. Frisby gives no indication as to whether his arrangement is sensitive enough to detect, say for example, a leak rate of twenty or thirty drops of leaked water per hour. While twenty to thirty drops per hour might seem negligible the cummulative effect over many weeks or months is surprisingly substantial and the resulting damage as great as if the leak was large and sudden. A further deficiency inherently present in Frisby resides in the absence of any means to ensure that upon leak detection that the volume of water in the heater is drained to a point where no damage will follow. It is also observed that no alarm is given as to the appearance of a leak.

In this regard it is noted that others in the field of boiler control have provided alarms when a condition within the boiler is inappropriate. One such system as shown in the patent to Williams U.S. Pat. No. 4,196,341 provides for the setting off of an alarm. The Williams system for monitoring the operation of an electric boiler also provides a control for a drain which drain control operates intermittently to aid in the continuous addition of fresh water to the boiler. Other examples of boiler condition detection and alarm generation will be found in the patents to Seklga, U.S. Pat. No. 4,256,258, titled, "Temperature Monitor and Alarm"; Kaczmarek et al, U.S. Pat. No. 3,834,357 titled, "Low Water Cut Off System".

In a somewhat unrelated field, rain detection and the sounding of alarm upon the start of precipitation is shown in the patent to Stroud, U.S. Pat. No. 1,109,481. The patent to Stroud is directed to a rain ennunciator which includes electrical contact members 16 and 17 having a hygroscopic element 20 position there between. When rain falls on the hygroscopic element 20 an electrical circuit is completed through the moisture between the two contacts 16, 17 which completes a circuit including a source of power and an alarm bell 13,14.

In Stroud the drying out of the hydroscopic material results in the interruption of the circuit and the bell ceases to ring.

It is against this background of teachings of the prior art that the invention to be described provides a water leak control circuit for use with a water heater having an inlet and a drain. The water leak control circuit simultaneously detects leaks, actuates an alarm, shuts off a water supply to the water heater, drains the heater and releaseably maintains the alarm activated, the water supply shut off and the heater drained. The just enumerated features are collectively and singularly absent from the prior art reviewed herein before.

DISCLOSURE OF THE INVENTION

To be more specific this invention relates to a hot water tank leak control circuit for a water heater having a cold water inlet and an outlet. The circuit includes a power supply and an electromagnetic valve which controls the inlet. The electromagnetic inlet valve is biased to a closed position when power is removed from the electromagnetic inlet valve.

A circuit control unit is connected in series with a reset control arrangement and the power supply. The circuit control unit is controllingly connected to the reset control arrangement, an inlet water supply valve control and an alarm control unit.

The inlet water supply valve control is controllingly coupled to the electromagnetic inlet valve and the alarm control unit is controllingly coupled to the alarm.

The invention further contemplates the inclusion of a leak responsive circuit which has a portion thereof positioned beneath the water heater whereupon the appearance of leaking water from the heater causes a change in the electrical property of a circuit component in the leak responsive circuit.

The leak responsive circuit is electrically coupled between the circuit control unit and the power supply to thereby interrupt electrical power to the circuit control unit and the reset control arrangement which results in the deenergization of the circuit control unit and the simultaneous closing of the electromagnetic inlet valve and the activation of the alarm.

The circuit control unit is controlled by the reset control arrangement to remain deenergized even though the leak responsive circuit is opened due to the subsequent evaporation of the leaked water from the circuit component in the portion of the leak responsive circuit exposed to the leak. The invention further includes means to automatically drain the water heater upon detection of a leak.

It is therefore a primary object of this invention to provide a hot water tank leak control circuit which simultaneously detects leaks, actuates an alarm, shuts off the water supply to the water heater while draining the heater and releaseably maintaining the alarm activated, the water supply shut off and the heater drained.

A further object of the invention is to provide a water tank leak control circuit that is provided with a secondary power source in the form of a battery.

Yet another object of the invention is to employ in a water leak detection circuit a circuit component which normally provides an open circuit connection which component in the presence of moisture changes in electrical property to an electrical shunt which results in the shunting of electrical power from the power source through the circuit component thereby interrupting power to the circuit control unit which results in the shutting off of the water supply to the tank as well as the other simultaneous functions heretofore enumerated.

Still yet another object of the invention is to employ in a water leak detection circuit a circuit component which normally functions as a capacitor. The capacitor normally functions as part of a circuit that includes an oscillator coupled to a resonant circuit having the capacitor in series with a reactor. The reactor has a portion thereof transformer coupled to an AC to DC rectifier which is in turn electrically coupled to a main circuit control unit to provide power thereto. The capacitor is responsive to the presence of moisture such that moisture from leaked water from the heater creates an electrical resistance in multiple with the capacitor thereby disturbing the resonance of the resonant circuit which results in the interruption of power to the main control circuit which results in the shutting off of the water supply and other simultaneous functions.

In the attainment of the foregoing objects, the invention includes in its most complete embodiment a water leak control circuit in combination with a water heater having an inlet and a drain. The water leak control circuit simultaneously detects leaks, actuates an alarm, shuts off a water supply to a water heater inlet, while draining the heater and releaseably maintaining said alarm activiated, said water supply shut off and said heater drained.

The control circuit includes a power supply that includes a primary power source and a secondary power source in the form of a battery. The secondary power source is connected in parallel with the primary power source where upon failure of the primary power source there remains the secondary power source to provide power to an inlet water supply valve control unit and an alarm control unit, both of which will be described more fully hereinafter.

The inlet to the water heater is controlled by an electromagnetic inlet valve which is biased to a closed position when power is removed from the electromagnetic inlet valve.

The water heater drain is controlled by an electromagnetic drain valve which is biased to an open position when power is removed from the electromagnetic drain valve.

A circuit control unit is connected in series with a reset control circuit and the power supply.

The circuit control unit is controllingly connected to the reset control circuit, an inlet water supply valve control unit, an alarm control circuit and a heater drain control circuit.

The inlet water supply valve control unit and said heater drain control circuit are respectively independently controllingly coupled to the electromagnetic inlet valve and the electromagnetic drain valve, and the alarm control circut is controllingly coupled to said alarm.

A leak responsive shunt circuit or a series connected oscillator/resonant circuit having a capacitor is designed to have an electrical component portion thereof positioned beneath the water heater whereupon the appearance of leaking water from the heater causes completion of an electrical shunt connection in the shunt circuit or a change in the resonant circuit, either of which interrupts power to circuit control unit.

The leak responsive circuit is electrically coupled between the circuit control unit and the power supply to thereby interrupt electrical power from the circuit control unit and the reset control circuit which results in the deenergization of the circuit control unit and the simultaneous closing of the electromagnetic inlet valve, the opening of said electromagnetic drain valve and finally, the activation of the alarm.

The circuit control unit is controlled by the reset control circuit to remain deenergized even though the leak responsive circuit as a consequence of the subsequent evaporation of leaked water from the electrical component portion of leak responsive shunt circuit is no longer interrupted.

In the preferred embodiment, the invention further entertains the provision that this circuit control will include a circuit control relay connected in series with the power supply and a normally biased open, manually closeable switch. The circuit control relay has a front contact switch in parallel with the normally biased open manually closeable switch to thereby provide an electrical connection to be made over the front contact in series with the circuit control relay and the power supply only upon the manual closing of said normally biased open, manually closeable switch. It is to be noted that the just mentioned circuit control relay controls a water supply switch in the water supply control means to provide power to maintain the electromagnetic inlet valve open. The circuit control relay also simultaneously controls an alarm control switch in the alarm control circuit to provide power to the alarm only when the circuit control relay is deenergized.

Other objects and advantages of the present invention will be apparent upon reference to the accompanying description taken in conjunction with the following drawings.

BEST MODE FOR CARRYING OUT THE INVENTION

Figure 1:
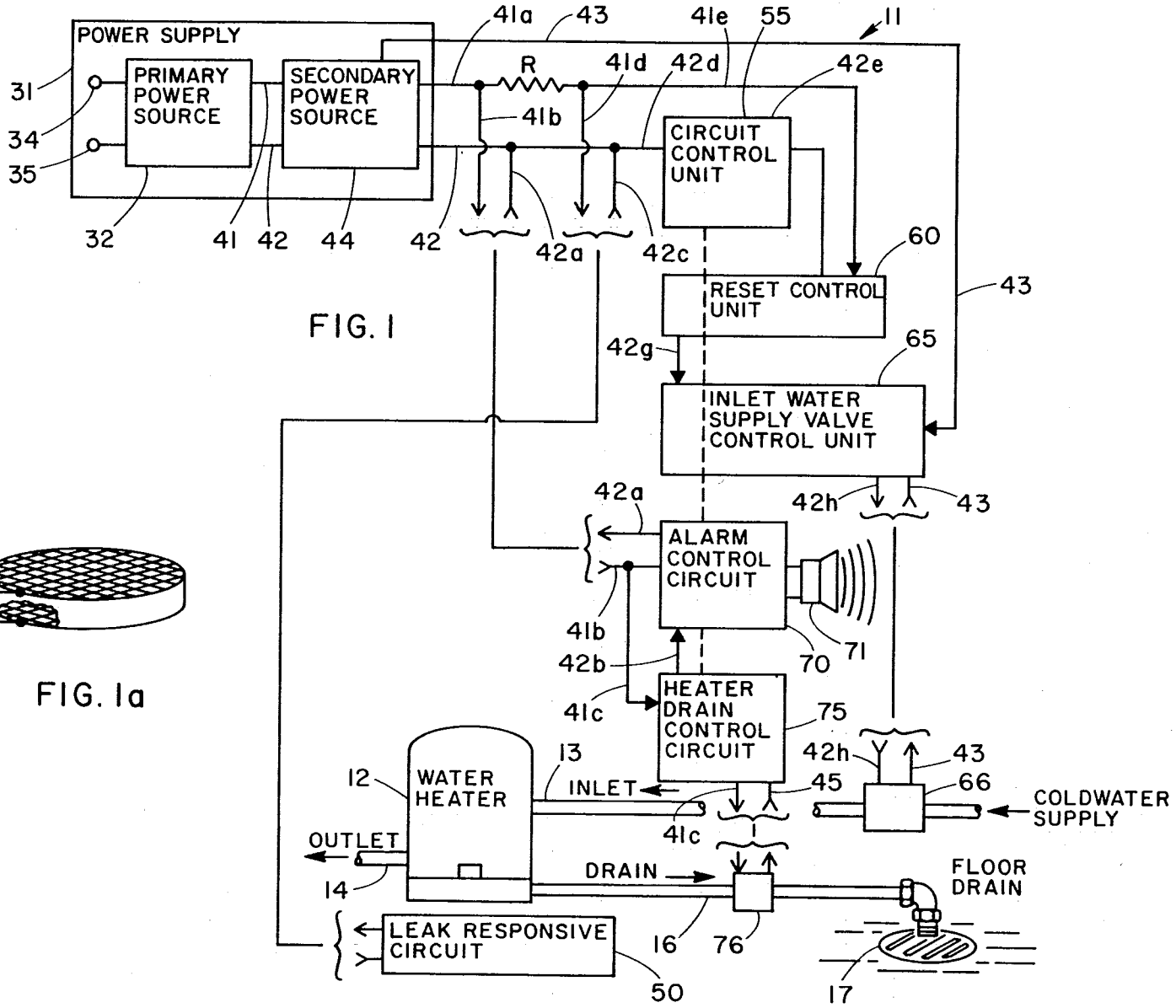
FIG. 1 illustrates in block diagram form the hot water heater leak control circuit of the invention.

Reference is now made to FIG. 1 which illustrates in block diagram form a preferred embodiment of the water leak control circuit 11 of the invention. The water leak control circuit is utilized in conjunction with a water heater 12 which heater 12 is shown having a cold water inlet pipe 13, a hot water outlet pipe 14 and a drain pipe 16.

The water leak control circuit 11 is provided with a power supply 31 which includes a primary power source 32 electrically coupled to terminal 34, 35. The primary power source 32 is in turn electrically connected via leads 41, 42 to a secondary power source 44. The primary and secondary power sources will be explained in more detail hereinafter in respect of the description of FIG. 2.

The cold water inlet pipe 13 is controlled by an electromagnetic inlet valve 66. The details of the electromagnetic valve 66 do not form a part of invention and will only be briefly described. The electromagnetic inlet valve 66 includes a solenoid, not shown, which is activated by the appearance of power on leads 42*h*, 43. The solenoid is spring biased in such a manner as to cause the valve to be open when power is applied and to close automatically when power is removed from the electromagnetic inlet valve 66.

The drain pipe 16 is controlled by an electromagnetic drain valve 76 which has a solenoid, not shown, powered via leads 41*c*, 45. The electromagnetic drain valve 76 is biased to an open position when power is removed from the electromagnetic drain valve 76. The drain valve 76 is coupled via pipe 16*a* to a floor drain 17 shown schematically to the right in FIG. 1.

A circuit control unit 55 is connected in series with a reset control circuit 60 via leads 42, 42*d*, 42*e*, 41*e*, resistor R and lead 41*a* to power supply 31.

The control circuit 55 is controllingly connected via mechanical connection 40, here shown in broken line, to the reset control circuit 60, an inlet water supply valve control unit 65 an alarm control circuit 70 and a heater drain control circuit 75.

It is to be noted that the inlet water supply valve control unit 65 is controllingly coupled via leads 42*h*, 43 to the electromagnetic inlet valve 66. The heater drain control circuit 75 is controllingly coupled via leads 41*c*, 45 to the electromagnetic drain valve 76 and the alarm control circuit is controllingly coupled to an alarm 71. Power to operate the alarm is delivered over leads 41*a*, 42 and 41*b*, 42*a*, the latter being electrically connected to the alarm control circuit 70. The alarm 71 is here shown schematically as an audio speaker. The exact nature of the alarm is not critical to the invention and may include, a light, bell etc.

Of major significance to the invention is the incorporation of leak response circuit 50 shown having a portion thereof positioned beneath the water heater 12. The location of a portion of the leak responsive circuit 50 beneath the heater 12 allows in the leaking water from the heater 12 to fall upon that portion of the circuit 50 and cause a change in the electrical property of a circuit component, not shown, in that portion of the leak responsive circuit 50.

The leak responsive circuit 50 is electrically connected to and across leads 41*a*, 42 from the power supply 31 via leads 41*d*, 42*c*. As will be noted from the drawing of FIG. 1 this just described connection places the leak responsive circuit 50 electrically coupled between the circuit control unit 55 and the power supply 31 to thereby allow the interruption of electrical power to the circuit control unit 55 and the reset control circuit 60 whenever water leaks and there arises the electrical property component change. The interruption of power that is attendant with the electrical property change results in the deenergization of the circuit control unit 55 which causes mechanical connection 40 to fall downwardly thereby controlling the inlet water supply valve control unit 65 to remove power from electrmagnetic valve 66 which results in the automatic shutting off of the cold water supply pipe 13. The just noted downward movement of the mechanical connection 40 also results in the denergisation of the electromagnetic drain valve 76, all as a consequence of mechanical connection 40 input to the heater drain control circuit 75.

Simultaneous with the deenergization of the electromagnetic inlet valve 66 and the electromagnetic drain valve 76 the movement of the mechanical connection 40 also provides an input to the alarm control circuit 70 which results in the activation of the alarm 71.

A further novel feature of the water leak control circuit of the invention resides in the fact that the circuit control unit 55 is controlled by the reset control circuit 60 to remain deenergized even though the leak responsive circuit 50 is restored to a normal condition due to the subsequent evaportation of the leaked water from the portion of the leak responsive circuit under that water tank.

Figure 1A:
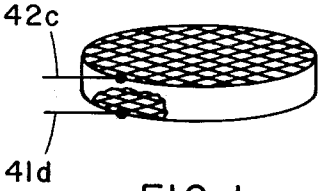
FIG. 1*a* shows in three dimensional form the details of a portion of shunt circuit employed in carrying out the invention.

Reference is now made to FIG. 1*a* in which there is shown in three dimensional form a crucial component 51 of the leak responsive circuit 50. The circuit component is made up of electrically conductive wire mesh elements 52, 53 which have positioned there between a mat 54 which has been impregnated with sodium chloride or other suitable salt that will allow the conduction of electricity from the top wire mesh element 52 through to the bottom wire mesh element 53 when moisture is present. The electrical connection just described would change the normally dry circuit component 51 to an electrical shunt in the presence of leaked water from the tank 12. The overall configuration and location of the circuit component 51 is such that any leak in the water tank 12 would eventually fall upon the circuit component 51 and assure the completion of the electrical shunt.

Figure 2:
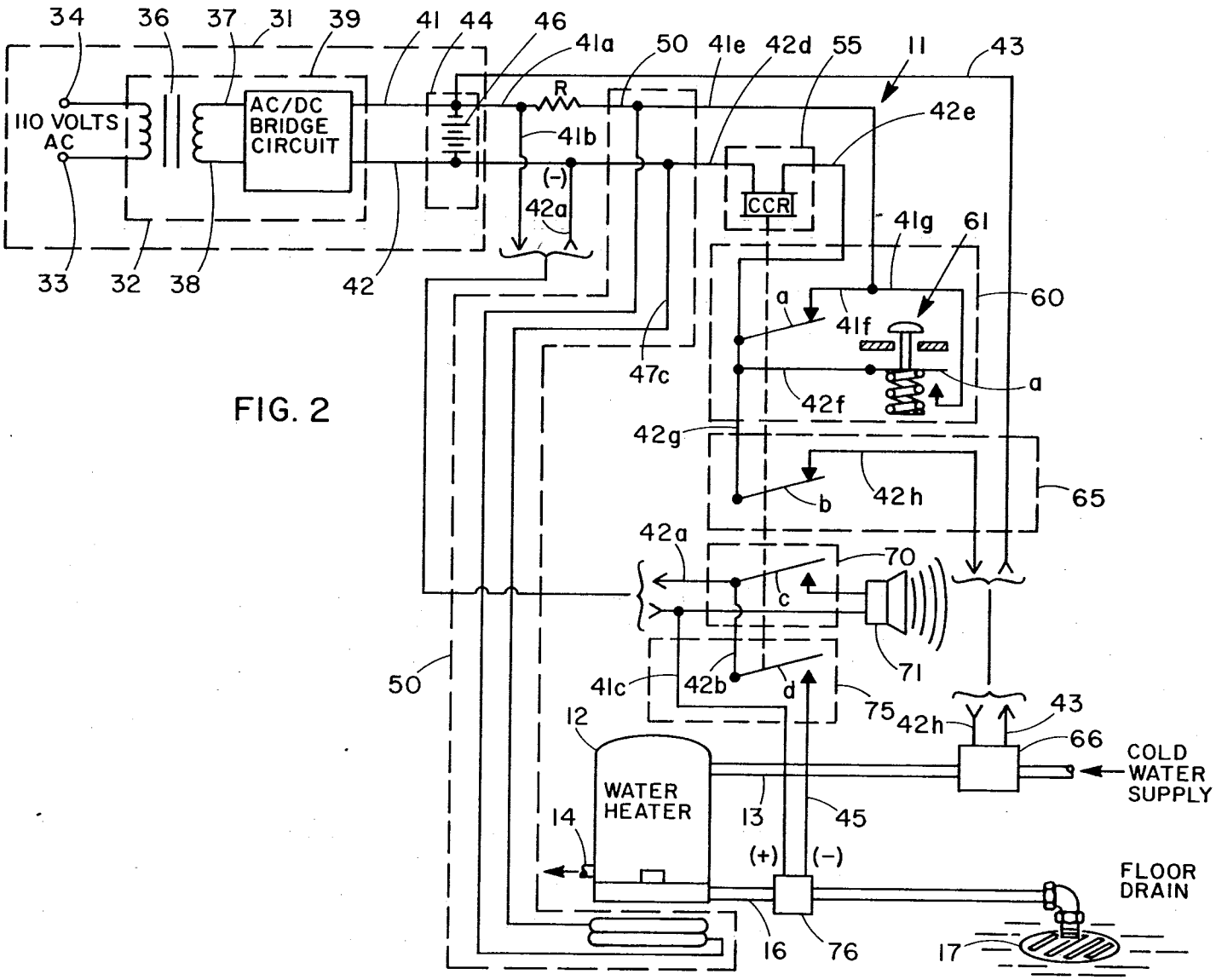
FIG. 2 shows an embodiment of the invention which includes the details of a complete electrical circuit incorporating a moisture responsive shunt circuit

Reference is now made to FIG. 2 which illustrates a complete circuit arrangement shown in sufficient detail to carry out the practice of the invention. It is to be understood that when ever reference numerals employed in FIG. 1 with respect to various elements are utilized again in any subsequent figure the reference numerals will denote the identical elements with identical functions as that described in respect of any earlier figure.

In the review of FIG. 2 each of the various components of the water leak control circuit of FIG. 1 will be described in detail in order to present a teaching of how one may practice the invention.

The power supply 31 here shown outlined by broken lines includes a primary source of power 32 which in practice would be normally available household current at 110 volts A.C. here shown delivered to terminals 34,35. The A.C. current passes through a conventional step down transformer 36 and is in turn delivered over leads 37, 38 to an AC/DC bridge circuit of conventional design to provide a DC voltage access leads 41, 42 to a battery 46 which forms a secondary power supply 44. The secondary power supply 44 in the form of battery 46 will find its utility when and if there is a power outage in respect of the household power supply.

In the description that immediately follows the detailed description of the components will be presented in the following order, leak responsive circuit 50, circuit control unit 55, reset control circuit 60, inlet water supply valve control unit 65, alarm control circuit 70 and the heater drain control circuit 75.

The leak responsive circuit 50 is shown to include a circuit component 51 connected by leads 41*d*, 42*c* respectively across leads 41*e*, 42 that emenate from the power supply 31.

The circuit control unit is composed of a circuit control relay (CCR) one side of which is electrically connected to the power supply 31 via leads 42*d* and 42. The other side of the CCR is electrically connected via lead 42*e* to reset control circuit 60 and the reset control circuit 60 is in turn connected to the power supply 31 via lead 41*e*, resistor R, and leads 41*a*, 41.

It is to be noted that CCR operates via mechanical connection 40 to simultaneously control contact a in the reset control circuit 60, contact b in the inlet water supply valve control circuit 65, contact c in the alarm control circuit 70 and contact d in the heater drain control circuit 75.

Attention is now directed to the reset control circuit 60 and its operation in the mode illustrated. As was just noted the power supply 31 has a circuit completed through the CCR which circuit includes the following: lead 41*a*, resistor R, leads 41*e*, 41*f*, front contact a of CCR, lead 42*e*, CCR and lead 42*d*, 42.

It should be readily appreciated that the appearance of a water leak and the ensuing change from open circuit to complete shunt circuit through electrical component 51 results in the shunting of power from the CCR of this circuit control unit 51 which results in the deenergization of CCR. The deenergization of CCR results in the opening of front contacts a and b respectively of the reset control circuit 60 and the inlet water supply valve control unit 65. The deenergization of CCR additionally, simultaneously closes back contacts c and opens contact d respectively of the alarm control circuit 70 and the water drain control circuit 75. The closing of the alarm circuit 70 and the opening of drain control circuit 75 causes the alarm 71 to be activated and the electromagnetic drain valve 76 to be opened to thereby drain the tank 12 upon the detection of a leak.

Returning now to the reset control circuit 60 and its operation, it will be seen that once the front contact a of CCR has opened in response to the detection of a leak in the tank 12, the reenergization of CCR cannot occur even if upon the passage of time the shunt created by moisture in the electrical component 51 disappears. This feature is important to the invention because there is always the possibility that the alarm will not be noticed or fail for some reason. In this event it would be highly desirable to make certain that the water tank not be refilled until it has been thoroughly checked for leaks.

In order to reset the water leak control circuit all that need be done is to depress the manually depressable, spring biased open switch 61 in order that a circuit be completed over the back contact a of switch 61. This circuit just noted will allow power from the power supply 31 to travel to and through the CCR over leads 41*a*, resistor R, leads 41*e*, 41*g*, back contact a of manual switch 61, lead 42*f*, lead 42*e*, CCR, lead 42*d* and 42. The completion of the just noted circuit results in the resetting of the entire system.

The inlet water supply valve control unit 65 is electrically coupled to the reset control circuit by electrical lead 42*g* and to the power supply 31 via lead 43. The opening or closing of the b contact of CCR controls the flow of power to the electromagnetic valve 66.

The alarm control circuit 70 and the heater drain control circuit are similar in that each respectively includes a single switch contact member c and d controlled by CCR and the mechanical connection 40.

Figures 3, 3A:
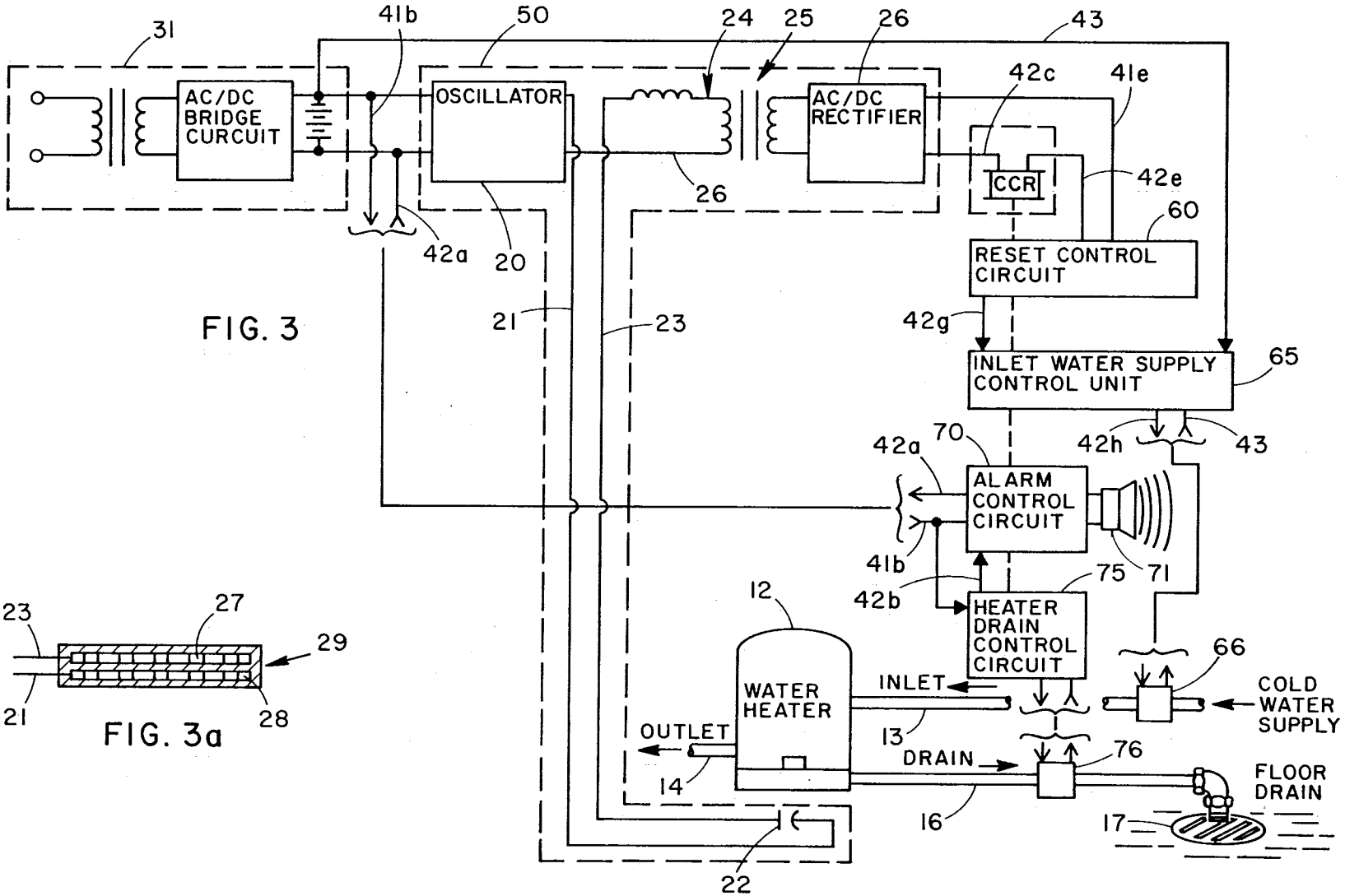
FIG. 3 shows another embodiment of the invention which includes a complete electrical circuit incorporating an oscillator/capacitor resonant circuit to detect leaked water.
FIG. 3*a* illustrates in schematic form a perforated metal disk capacitor for use in the invention's embodiment of FIG. 3.

Reference is now made to FIG. 3 which illustrates another embodiment of the invention where in the leak responsive circuit here indicated as 50' takes on a different configuration. It will be observed that in all other respects the components of the water leak control circuit 11 is the same as that shown in FIGS. 1 and 2. Accordingly the description of these components will not be restated as the earlier description and reference numeral usage provide a full complete description the interrelated functions of the various components.

As shown in FIG. 3 the circuit component 51' is a capacitor 22. The general configuration of the capacitor 22 is shown in FIG. 3*a* and includes a pair of perforated metal plates 27, 28 mounted in a moisture admitting material 29. The details of the capacitor construction do not form a novel facet of the invention. In fact any capacitor may be employed that will permit the entry of leaked water which will result in the change of the electrical property of the capacitor circuit component.

The leak responsive circut 50' includes an oscillator 20 coupled to a resonant circuit via leads 21 and 26. The resonant circuit includes the capacitor 22 in series with a reactor 24 here shown schematically the transformer 25 coupled to an AC to DC converter unit 26, which is in turn electrically coupled as shown to this circuit control unit 55 to provide power thereto.

The capacitor 22 is responsive to the presence of moisture in the form of leaked water from the tank 12 such that the leaked water creates an electrical resistance in multiple with the capacitor 22 thereby disturbing the resonance of the resonant circuit which results in the interruption of power to the circuit control unit 55.

Although the invention has been illustrated and described in an embodiment that is illustrated with only two types of leak responsive circuits ie shunt and oscillator/capacitor resonant, it should be understood that the invention contemplates in a broader sense other leak responsive circuits. While the invention is shown in a preferred embodiment utilizing relay technology the invention also embraces the use of solid state electronic devices to accomplish the functional ends of the invention. Accordingly, it will be apparent to those skilled in the art that various changes may be made therein without departing from the spirit and scope of the invention as set forth in the appended claims.

I claim:

1. A water leak control circuit in combination with a water heater having an inlet; said water leak control circuit providing for the simultaneous detection of leaks, activation of an alarm, shutting off a water supply to said inlet and releaseably maintaining said alarm activated and said water shut-off, said control circuit including:

a power supply means, said inlet controlled by an electromagnetic inlet valve means which is biased to a closed position when power is removed from said electromagnetic inlet valve means, circuit control means connected in series with a reset control means and said power supply means, said circuit control means controllingly connected to said reset control means, an inlet water supply valve control means, and an alarm control means, said inlet water supply valve control means is controllingly coupled to said electromagnetic inlet valve means and said alarm control means is controllingly coupled to said alarm, a leak responsive circuit means having a portion thereof positioned beneath said water heater whereupon the appearance of leaking water from said heater causes a change in the electrical property of a circuit component in said leak responsive circuit means, said leak responsive circuit means electrically coupled between said circuit control means and said power supply means to thereby interrupt electrical power to said circuit control means and said reset control means which results in the deenergization of said circuit control means and the simultaneous closing of said electromagnetic inlet valve means and the activation of said alarm, said circuit control means controlled by said reset control means to remain deenergized even though said leak responsive circuit means which has had said leak induced circuit component electrical property change, restored to a normal condition due to the subsequent evaporation of said leaked water from said portion of said leak responsive circuit means.

2. The water leak control circuit of claim 1, wherein said circuit component is a normally open circuit connection which in the presences of moisture changes in electrical property to an electrical shunt which results in the shunting of electrical power from said power source through said circuit component thereby interrupting power to said circuit control means.

3. The water leak control circuit of claim 2 wherein said circuit control means includes a circuit control relay connected in series with said power supply and a normally biased open, manually closeable switch, said circuit control relay having a front contact switch in parallel with said normally biased open manually closeable switch to thereby provide an electrical connection to be made over said front contact in series with said circuit control relay and said power supply only upon the manual closing of said normally biased open, manually closeable switch.

4. The water leak control circuit of claim 3 wherein said circuit control relay simultaneously controls a water supply switch in said water supply control means to provide power to maintain said electromagnetic inlet valve means open and an alarm control switch in said alarm control means to provide power to said alarm only when said circuit control relay is deenergized.

5. The water leak control circuit of claim 4 wherein said circuit component of said leak responsive circuit means includes conductors spaced apart by material that when dry has an electrical insulating characteristic but when exposed to leaking water from said heater becomes electrically conductive thereby providing an electrical shunt connection.

6. The water leak control circuit of claim 5, wherein said power supply means includes a primary power source and a secondary power source connected in parallel whereupon the failure of the primary power source there remains the secondary power source to provide power to said inlet water supply valve control means and said alarm control means.

7. The water leak control circuit of claim 6 wherein said secondary power source is a battery.

8. The water leak circuit of claim 1 wherein the said circuit component is a capacitor and said leak responsive circuit includes a oscillator coupled to a resonant circuit having said capacitor in series with a reactor, said reactor having a portion there of transformer coupled to an AC to DC rectifier means which is in turn electrically coupled to said circuit control means to provide power thereto, such that said capacitor responsive to the presence of moisture from leaked water from said heater creates an electrical resistance in multiple with said capacitor thereby disturbing the resonance of said resonant circuit which results in the interruption of power to said circuit control means.

9. The water leak control circuit of claim 8 wherein said circuit control means includes a circuit control relay connected in series with said power supply and a normally biased open, manually closeable switch, said circuit control relay having a front contact switch in parallel with said normally biased open manually closeable switch to thereby provide an electrical connection to be made over said front contact in series with said circuit control relay and said power supply only upon the manual closing of said normally biased open, manually closeable switch.

10. The water leak control circuit of claim 9 wherein said circuit control relay simultaneously controls a water supply switch in said water supply control means to provide power to maintain said electromagnetic inlet valve means open and an alarm control switch in said alarm control means to provide power to said alarm only when said circuit control relay is deenergized.

11. A water leak control circuit in combination with a water heater having an inlet and a drain, said water leak control circuit simultaneously detecting leaks, actuating an alarm, shutting off a water supply to said water heater, draining said heater and releaseably maintaining said alarm activated, said water supply shut off and said heater drained, said control circuit including:

a power supply means, said inlet controlled by an electromagnetic inlet valve means which is biased to a closed position when power is removed from said electromagnetic inlet valve means, said drain controlled by an electromagnetic drain valve means which is biased to an open position when power is removed from said electromagnetic drain valve means, circuit control means connected in series with a reset control means and said power supply means, said circuit control means controllingly connected to said reset control means, an inlet water supply valve control means, and an alarm control means and a heater drain control means, said inlet water supply valve control means and said heater drain control means respectively independently controllingly coupled to said electromagnetic inlet valve means and said electromagnetic drain valve means, and said alarm control means controllingly coupled to said alarm, a leak responsive circuit means having a portion thereof positioned beneath said water heater whereupon the appearance of leaking water from said heater causes a change in the electrical property of a circuit component in said leak responsive circuit means, said leak responsive circuit means electrically coupled between said circuit control means and said power supply means to thereby interrupt electrical power to said circuit control means and said reset control means which results in the denergisation of said circuit control means and the simultaneous closing of said electromagnetic inlet valve means, the opening of said electromagnetic drain valve means and the activation of said alarm, said circuit control means controlled by said reset control means to remain deenergized even though said leak responsive circuit means which has had said leak induced circuit component electrical property change, restored to a normal condition due to the subsequent evaporation of said leaked water from said portion of said leak responsive circuit means.

12. The water leak control circuit of claim 1, wherein said circuit component is a normally open circuit connection which in the presence of moisture changes in electrical property to an electrical shunt which results in the shunting of electrical power from said power source through said circuit component thereby interrupting power to said circuit control means.

13. The water leak control circuit of claim 12 wherein said circuit control means includes a circuit control relay connected in series with said power supply and a normally biased open, manually closeable switch, said circuit control relay having a front contact switch in parallel with said normally biased open manually closeable switch to thereby provide an electrical connection to be made over said front contact in series with said circuit control relay and said power supply only upon the manual closing of said normally biased open, manually closeable switch.

14. The water leak control circuit of claim 13 wherein said circuit control relay simultaneously controls a water supply switch in said water supply control means to provide power to maintain said electromagnetic inlet valve means open and an alarm control switch in said alarm control means to provide power to said alarm only when said circuit control relay is deenergized.

15. The water leak control circuit of claim 14 wherein said circuit component of said leak responsive circuit means includes conductors spaced apart by material that when dry has an electrical insulating characteristic but when exposed to leaking water from said heater becomes electrically conductive thereby providing an electrical shunt connection.

16. The water leak control circuit of claim 15, wherein said power supply means includes a primary power source and a secondary power source connected in parallel whereupon the failure of the primary power source there remains the secondary power source to provide power to said inlet water supply valve control means and said alarm control means.

17. The water leak control circuit of claim 16 wherein said secondary power source is a battery.

18. The water leak circuit of claim 11 wherein the same circuit component is a capacitor and said leak responsive circuit includes a oscillator coupled to a resonant circuit having said capactor in series with a reactor, said reactor having a portion thereof transformer coupled to an AC to DC rectifier means which is in turn electrically coupled to said circuit control means to provide power thereto, said capacitor responsive to the presence of moisture such that said capacitor responsive to the presence of moisture from leaked water from said heater creates an electrical resistance in multiple with said capacitor thereby disturbing the resonance of said resonant circuit which results in the interruption of power to said circuit control means.

19. The water leak control circuit of claim 18 wherein said circuit control means includes a circuit control relay connected in series with said power supply and a normally biased open, manually closeable switch, said circuit control relay having a front contact switch in parallel with said normally biased open manually closeable switch to thereby provide an electrical connection to be made over said front contact in series with said circuit control relay and said power supply only upon the manual closing of said normally biased open, manually closeable switch.

20. The water leak control circuit of claim 9 wherein said circuit control relay simultaneously controls a water supply switch in said water supply control means to provide power to maintain said electromagnetic inlet valve means open and an alarm control switch in said alarm control means to provide power to said alarm only when said circuit control relay is deenergized.

* * * * *